United States Patent [19]

Duvieusart

[11] Patent Number: 4,832,534

[45] Date of Patent: May 23, 1989

[54] METHOD AND DEVICE FOR STRESSED ANCHORAGE

[75] Inventor: Jean-Claude Duvieusart, Lasne, Belgium

[73] Assignee: Compagnie D'Entreprises CFE, Brussels, Belgium

[21] Appl. No.: 102,504

[22] Filed: Sep. 29, 1987

[30] Foreign Application Priority Data

Oct. 2, 1986 [FR] France ..... 8613775

[51] Int. Cl.[4] ..... F21D 20/02

[52] U.S. Cl. ..... 405/261; 405/260

[58] Field of Search ..... 405/261, 260, 262, 244; 52/704

[56] References Cited

U.S. PATENT DOCUMENTS

| | | | |
|---|---|---|---|
| 3,650,112 | 3/1972 | Howlett et al. | 405/260 |
| 4,140,429 | 2/1979 | Herbst | 405/261 |
| 4,187,040 | 2/1980 | Donan | 405/261 X |
| 4,477,209 | 10/1984 | Hipkins et al. | 405/261 |
| 4,679,966 | 7/1987 | Yacisin | 405/261 |

*Primary Examiner*—Dennis L. Taylor

*Attorney, Agent, or Firm*—Pennie & Edmonds

[57] ABSTRACT

The invention relates to a device for fixing a stressed anchorage in rock, comprising sealing components (7) to be sealed in place at the end of a predrilled hole (6) by the sealing material contained in a cartridge (2) fitted in the head of the device and protected by a perforated cap (5). When the device is put in place, the sealing head is fastened to the anchorage sleeve (11) by an unlockable connecting element (9, 10).

17 Claims, 3 Drawing Sheets

METHOD AND DEVICE FOR STRESSED ANCHORAGE

BACKGROUND OF THE INVENTION

1. Field of the invention

The invention relates to a device for stressed anchorage in rock.

Similar anchorages are known, notably for the retention of the arch of tunnels excavated in rock. They allow the bolted rock to be stabilized and to exercise a prestress on the walls of these tunnels, leading to the possibility of a very fast and very sure advance of the excavation works, due to the ease of fixing.

Over the years various methods have been developed for installing this type of anchorage.

2. Description of the prior art

In accordance with the imperatives to which they are subjected, it is noticed that the short type anchorages are usually no longer than one or two meters and the long type anchorages reaching ten meters and more.

The short type anchorages are usually of an elementary design but easy to handle. They are not designed for the application of real prestress tensions as their length is limited. Moreover, their principle of operation is mechanically inapplicable to long type anchorages. One of the oldest amongst the short type anchorages is the Perfo type bolt in which two perforated half-cylinders packed tight with mortar are coupled together and inserted in the hole, the mortar then being forced through the perforations by percussion. The known disadvantages of this system are due to its precarious results, because of the small volume of mortar which it contains and the insufficient available control of the conditions of anchorage.

The Selfix type tie rods comprise a dual compartment breakable capsule filled with two-constituent resin fitted firmly on a metal rod of standardized length. After the capsule has split open, a drilling machine is fitted on Latter designed to complete the mixing of the constituents. Such a principle is inapplicable to long anchorages because of the couple to be applied to the tie rod and of the distortion of the tie rod.

Furthermore, with this method, it is not possible to carry out an injection of mortar filling later on.

The homogeneity of the mixture and the evenness of the hardening are always problematical.

The SWELLEX anchorage is realized by expansion of a draw tube with compressed air, its principle is completely different from that of anchorages fixed in place by a synthetic cement.

All these anchorage devices apply only to limited lengths of tie rod and are not designed to exert a real prestress tension.

The long type anchorages, usually heavy duty, have a part sealed to the bottom of the drilling hole connected by tie rods to an anchorage head resting on the opening of this hole. Such anchorages enable several tens of tons of prestress tension to be exerted on the rock, the sealed part being ten meters or more distant from the anchorage head.

Most of these methods or devices for anchorage require either an injection or an introduction of sealing material before the tie rods are placed in position, which obviously doubles the handling operations necessary or the introduction of this sealing material after the anchorage device has been placed in position, a method requiring more time, as well as an elaborate design, more costly and the source of operational snags.

The Dywidag type anchorages use anchorage tie rods made of threaded bars partially sleeved with a sealing sleeve, the end of which is sealed with resin. The introduction of the sealing material is carried out before the placing in position of the anchorage tie rods; it is not possible with simultaneous check later on of the anchorage tension.

These anchorages use a sealing of two-constituent resin whose hardening homogeneity always depends on the quality of the mixture in situ.

In the type BBRV anchorages, the cables in bunches are protected along one part of their length by a sheath fitted with a sealing collar. The injection of sealing takes place under pressure via a special unit (injection pipe) and is carried out after the anchorage is placed in position in the cavity.

These various methods call for considerable handling operations when being placed in position.

SUMMARY OF THE INVENTION

One of the objects of the invention is the production of a prestressed anchorage device able to be placed in position in a single operation.

Another object of the invention is an anchorage device where the data of the sealing operation are strictly controlled.

Another object of the invention is an anchorage device making it possible to check and rectify the tension, even after sealing with mortar later on.

Another object of the invention is a prestressed anchorage able to be placed under tension a very short time after its installation.

The subject of the invention is a method of producing stressed anchorages in rocky terrain, comprising the following steps: predrilling of a drilling hole, the making up of a cartridge of sealing material by extrusion, the fitting of the said cartridge in a protective cap at the head of the anchorage device comprising an anchorage sleeve surrounding a component for transmission of the traction and a sealing head, the introduction of the anchorage device in the cavity, the checking of the position of the said device, the separation of the sealing head from the anchorage sleeve, the crushing of the cartridge of sealing material by acting on the component for transmission of the traction, the hardening of the sealing material, the placing of the device under tension.

Preferably, the method also comprises the following steps: the coating, prior to assembly, of the component designed to transmit the traction by means of an organic compound suitable to prevent its adherence to the cement and the injection, after placing this component under tension, of a liquid filling of mortar in the anchorage sleeve, so that the said liquid filling fills up the whole of the anchorage sleeve and rises to the surface round its periphery.

Another subject of the invention is an anchorage device under stress in rocky terrain designed to be placed in position in a drilling hole, comprising:

- a sealing head suitable to be sealed in the rock,
- a moveable anchorage head suitable to rest against the wall around the mouth of the drilling hole,
- a traction component suitable to ensure a stress traction between the sealing head and the anchorage head, an anchorage sleeve suitable to be cemented in place, surrounding the said component for transmission of the traction.

This device also comprises:

a cartridge of sealing material made up of sealing material contained in an easily destructible casing fitted at the front of the sealing head, a perforated protective cap or "strainer" fixed to the anchorage sleeve and surrounding the said cartridge of sealing material, an unlockable connecting component between the sealing head and the anchorage sleeve, the said connecting component being suitable to be activated via the traction component.

According to an advantageous form of construction, the casing enclosing the cartridge of sealing material is a thin sheet of polymer material.

A synthetic mortar may be used advantageously as sealing material.

According to a preferred embodiment, the anchorage sleeve is closed at its rear end by an end piece fitted on the anchorage head; the anchorage head is crossed by two openings connecting, respectively, with the inner volume of the sleeve and with the volume of the drilling hole outside the sleeve, these two volumes being placed in communication towards the front of the device by the perforations of the protective cap.

According to an advantageous embodiment, the traction transmission component has a low coefficient of adherence in respect of its sleeving.

According to a preferred embodiment, the component transmitting the stress is a sleeved greased cable.

According to a particular embodiment, the sleeved greased cable is bared of its sleeving along part of its length.

According to a preferred form f construction, the sealing head comprises several modular sealing components having a profile suitable to assist the transmission of their anchorage force to the rock, via the sealing material strung along on the cable.

According to an advantageous form of construction, the unlockable fixing mechanism of the sealing head is a bayonet fitting.

An advantageous form of construction of the protective cap is that of a perforated grille.

Amongst the advantages of the invention over the classic methods of the existing technique, the following may be noted in particular:

due to its ease of handling, the anchorage device according to the invention may be used in a very versatile manner, with a minimum of material and even, should the occasion arise, with the use of semi-skilled labour;

when being placed in position, the cartridge is protected mechanically to avoid its premature opening. The exact place and time of the opening are thus controlled perfectly; in particular, it is possible to withdraw the cartridge during the operation in case of emergency;

the possibility of a supplementary injection of liquid filling under pressure strengthening, on the one hand, the anchorage sealing and improving, on the other hand, the qualities of the rock by encasing possible fissures by filling;

even after supplementary injection of this liquid filling of cement, the anchorage according to the invention retains the possibility of a retensioning at any time, as well as that of a permanent check of this tension;

the sealing material is drawn into compression both by the layout of the device and by the form of the sealing components, which is an advantageous factor;

a very great ease of handling; just like some short anchorages, the anchorage device of the invention forms a complete assembly with the cartridge of sealing material, the head entering into the predrilled anchorage hole, after fitting of the cartridge of sealing material in a single operation;

it is possible to adjust the free length of the anchorage easily by partially baring the traction component; likewise, it is easy to alter the sealed length with the sealing material by modifying the number of sealing components used, during the assembly of the anchorage; finally, the use of a flexible cable enables the employment of anchorages of a length greater than the diameter of the gallery and makes transport on site extremely easy.

BRIEF DESCRIPTION OF THE DRAWINGS

Other features and advantages of the invention will become evident from the detailed description of a preferred embodiment described hereafter with reference to the accompanying drawings, in which.

DETAILED DESCRIPTION OF THE INVENTION.

FIGS. 1 to 5 show in diagrammatic form the various phases in the use of the anchorage device according to the invention.

Figure 1:
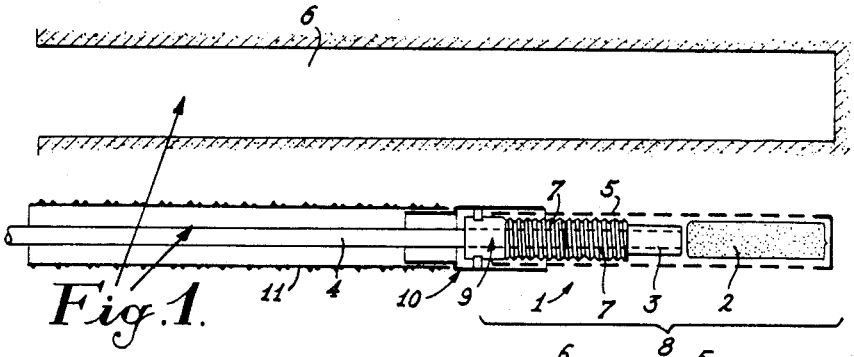
FIG. 1 is a diagrammatic view of the anchorage device according to the invention.

In FIG. 1, the anchorage device 1 is fitted with its cartridge of sealing material 2 whose constituents are mixed on site, prior to introduction. After preparation and extrusion, the cartridge of sealing material 2 is placed at the head of the device, resting against the threaded sleeve 3 crimped on the end of the sleeved greased cable 4. A perforated cap 5 (also called a strainer) protects the cartridge 2 during its introduction into the drilling hole 6.

The sealing components 7 (whose role will be explained later) are fitted on the cable 4 on this side of the threaded sleeve.

The assembly of sealing components 7 and the threaded sleeve 3 fitted on the end of the cable 4 form the sealing head 8.

The sealing head 8 is fixed to the anchorage sleeve and the perforated cap 5 by means of the unlockable connecting components 9, 10 (shown in more detail in FIGS. 7, 8, 9, and 10).

Figure 2:
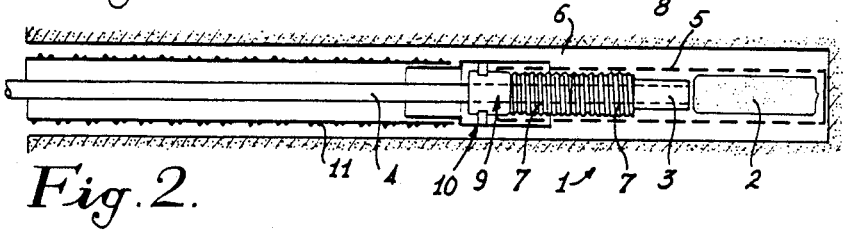
FIG. 2 is a view in diagrammatic section of the same device introduced into the anchorage hole.

FIG. 2 is a view in diagrammatic section of the anchorage device 1 introduced into the predrilled hole 6. The anchorage sleeve 11 and the sleeved greased cable 4 form an assembly of sufficient rigidity so that the sealing head 8 may be introduced without trouble into the drilling hole 6, just as though it was fitted on the end of a pole. However, the assembly is sufficiently flexible to follow the shape of the irregularities and may bend at will to the dimensions on site; in particular, it is perfectly possible to place an anchorage whose length is greater than the diameter of the gallery where the work is being carried out.

Figure 3:
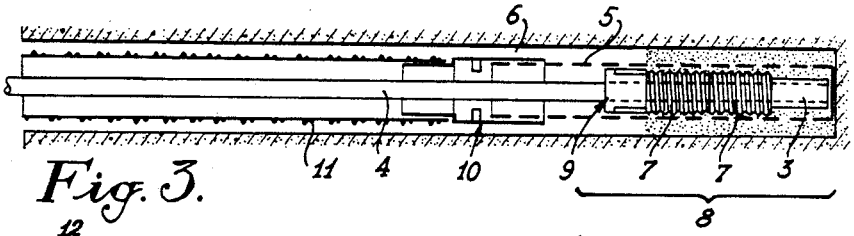
FIG. 3 is a view of the anchorage device after crushing of the cartridge of sealing material.
Figure 7:
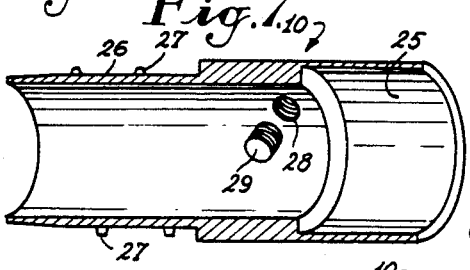
FIG. 7 a sectional view in perspective of a sleeve of the component connecting the cable to its anchorage sleeve.
Figure 8:
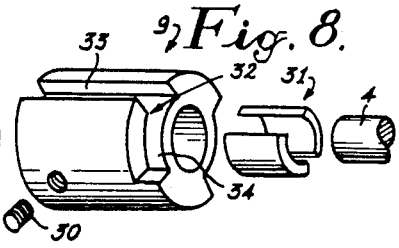
FIG. 8 is a view in perspective of the cable clamp corresponding to the coupling sleeve described in FIG. 7.

FIG. 3 is a view in diagrammatic section of the anchorage device 1 after crushing of the cartridge 2. When the end of the sealing head 8 comes into contact with the end of the hole, the operator unlocks the connecting components 9, 10 (in this case, joined together by a bayonet fitting) which keep the sealing head 8 and the anchorage sleeve 11 integral. To do this, a twist is exerted on the cable 4 so as to disengage two pins 29 from the right-angled elbow slots 32, made on the lateral face of the cylindrical cable clamp 9 (FIGS. 7 and 8).

After unlocking, the sealing head 8 and the cable 4 may slide longitudinally in relation to the anchorage sleeve 11. A thrust applied to the cable 4 is sufficient to pierce the cartridge of sealing material 2 whose contents spread themselves into the cavity, work their way through the openings of the protective cap 5 and engulf the sealing components 7.

These latter components contribute significantly to the effectiveness of the anchorage device according to the invention. They are shown in more detail in FIG. 6.

The anchorage device 1 is left to rest during the period necessary for the sealing material to set (for example, several hours for synthetic mortar), after which it may be placed directly under tension.

Figure 4:
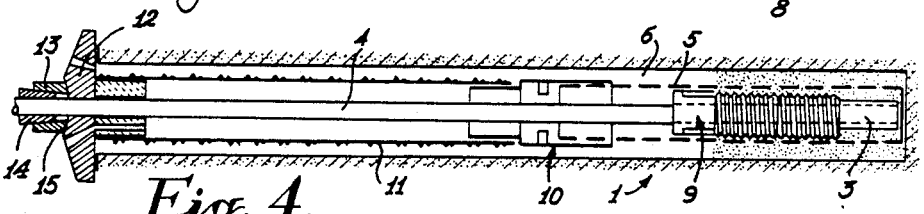
FIG. 4 is a view of the device after hardening of the sealing material and placing under tension.

FIG. 4 shows the anchorage device 1 after being placed under tension. An anchorage plate 12 is arranged on the mouth of the drilling hole. A tapered wedge pot 13 is fitted on the anchorage plate 12, this assembly forming the anchorage head. The application of a screw jack enables the tensioning of the cable which is then held under tension in the tapered wedge pot 13 by tapered wedges 14. The centering of the tapered wedge pot 13, in relation to the drilling axis, is ensured by the presence of a ball joint 15. A more detailed view will be shown in FIG. 11. At this stage, the anchorage device may be used just as it is, the cable 4 remaining free in its anchorage sleeve 11, which provides it with a first protection. However, this protection may be reinforced by injecting a liquid filling of cement mortar in the cavity 6, which is carried out under controlled conditions due to the design of the anchorage sleeve 11 and the anchorage plate 12, as will be seen by referring to FIG. 5.

Figure 5:
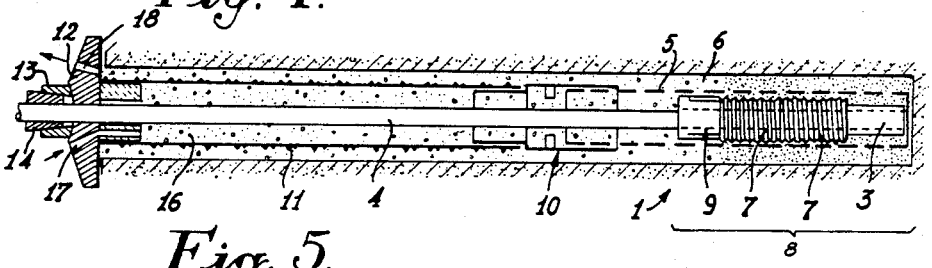
FIG. 5 is a view during injection of the liquid mortar filling.

FIG. 5 is a view in diagrammatic section of the anchorage device 1 during the injection of the filling mortar 16.

Two holes are drilled in the anchorage plate 12. A first opening 17 emerges inside the anchorage sleeve 11. A second opening emerges in the drilling hole 6 on the outside of the anchorage sleeve 11.

A liquid filling of cement mortar 16 is injected under pressure through the opening 17. This liquid filling of mortar 16 flows along the anchorage sleeve 11 and reaches up level with the perforated protective cap 5.

The length of the perforated protective cap 5 is such that the rear end emerges from the mass gripped in the sealing material.

The liquid filling of cement mortar 16 injected under pressure penetrates via the openings in the existing length of the cap 5 and flows back via the outside of the anchorage sleeve 11 up to the opening 18, so proving the continuity of the covering. This liquid filling 16, once hardened, consolidate$ the rock round the anchorage device 1, ensures a second protection for it and reinforces the sealing of the sealing head 8.

Due to its covering of grease, the cable 4 may continue to move freely in relation to its sleeve 19, even after the injection of the mortar 16. The cable 4 may thus continue to exert the prestress tension freely on the surrounding rock.

Depending on the demands of the site, a cable 4 may also be provided devoid of its covering and its sleeve 19 on all or part of its length, so that it becomes partially immobilized in its gang of mortar, after pouring of the mortar 16, which ensures an additional length of anchorage and so modifies the features of the anchorage in consequence.

Figure 6:
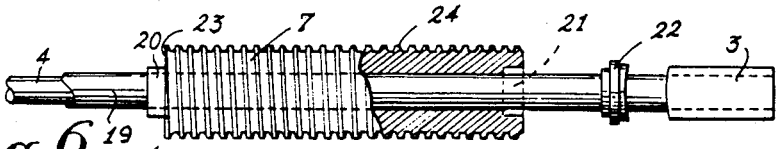
FIG. 6 a more detailed lateral view of a sealing component.

FIG. 6 is a more detailed lateral view of a sealing component 7. As it has been mentioned earlier on, the sealing head 8 comprises a number of components 7 variable depending on the stresses imposed on the anchorage and the quality of the rock. Optionally, these sealing components 7 are extended, at the rear, by a male part and, at the front, by a female part of corresponding shape.

During assembly, the male part 20 of each component 7 engages itself in the female part 21 of the following component, thus the sealing head 8 has no discontinuity.

A thrust ring 22 is fitted between the first component 7 and the threaded sleeve 3 so as to spread the pressure exerted by it evenly. The presence of this ring is justified by the possible irregularities appearing to the front surface 23 of the sealing components 7 depending on their method of construction; the thrust ring 22 could be omitted, should the occasion arise. The sealing component 7, shown here in machined chined metal, may also be made in cast metal, in concrete or in synthetic materials, such as resin or plastic.

The lateral surface of the sealing components 7 has reliefs 24 suited to improve their settlement in the cavity 6. The reliefs 24 shown on the figure have the shape of a raised helix, but it is evident that they may have any gripping profile compatible with their method of construction and the material employed.

FIG. 7 shows a sectional view in perspective of the coupling sleeve 10 which forms the first part of the connecting component 9,10 between the anchorage sleeve 11 and the sealing head 8 described in FIG. 1.

The end of this sleeve 10, facing the sealing head 8, is hollowed out with a counterbore 25 designed for the insertion of the protective cap 5.

The other end of the sleeve 10 is extended by an end piece 26 covered with reliefs 27 able to interlock the sleeve 10 to the anchorage sleeve 11.

The sleeve 10 is drilled with two holes 28 diametrically opposite, where some pins 29 are fixed protruding into the inner part of the sleeve 10.

FIG. 8 shows, in perspective, the cable clamp 9 corresponding to the coupling sleeve 10 shown in FIG. 7. This cable clamp 9 is fixed to the cable 4 downstream of the sealing components 7 by a binding screw 30 pressing here against a split ring 31. The lateral face of the cable clamp 9 has two right-angled recesses 32 made from a rectilinear part 33 parallel to the axis of the cable clamp 9 and a part, curved through about 90°, following the perimeter of the cable clamp.

Figure 9:
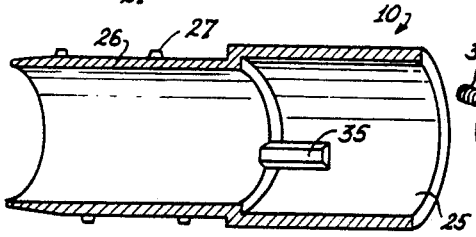
FIG. 9 is a sectional view in perspective of another execution of the coupling sleeve.

FIG. 9 is a sectional view, in perspective, of a variant of the coupling sleeve 10, more especially suited to a casting manufacturing method. The embodiment differs notably by the shape of the pins 35 strengthened longitudinally.

Figure 10:
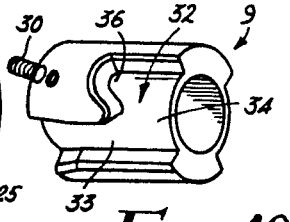
FIG. 10 is a view in perspective of the cable clamp corresponding to the sleeve shown in FIG. 9.

FIG. 10 is a view, in perspective, of the cable clamp 9 corresponding to the coupling sleeve described in FIG. 9.

The curved part 34 of the angled recess 32 is wider, to match the enlarged dimension of the pins 35, and has an enlargement 36 at its end section designed to prevent the pins 35 from coming out of their location under the effect of stresses.

Figure 11:
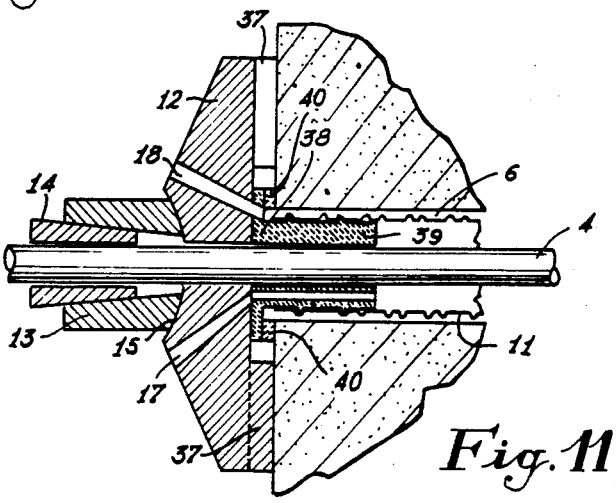
FIG. 11 is a more detailed sectional view of the anchorage head.

FIG. 11 is a more detailed view, in section, of the arrangement for placing the anchorage device 1 under tension.

The anchorage plate 12 has some jaws 37 designed to spread the thrust evenly on the wall.

The mouth of the drilling hole is closed by a closure piece 38 having an end cylinder 39 designed to be pressed into the end of the sleeve 11 and a seal 40 resting against the rock wall round the drilling hole 6. Two openings 17,18 pass through the anchorage plate 12 and emerge, respectively, at the end of the end cylinder 39, into the inside volume of the anchorage sleeve 11, and at the periphery of the drilling hole 6, in the outside volume of the anchorage sleeve 11.

The maintaining of the cable 4 under tension is ensured by the grip of the tapered wedges 14 in the tapered wedge pot 13. The alignment of the maintaining device 13, 14 with the axis of the cable 4 takes place automatically due to the presence of the ball joint 15. Due to the tapered wedge pot 13, the tensioning ("bolting") of the anchorage device 1 is simplified because this attachment system does not need a nut to be moved by rotation while the tensioning jack exerts a traction on the anchorage rod.

Figure 12:
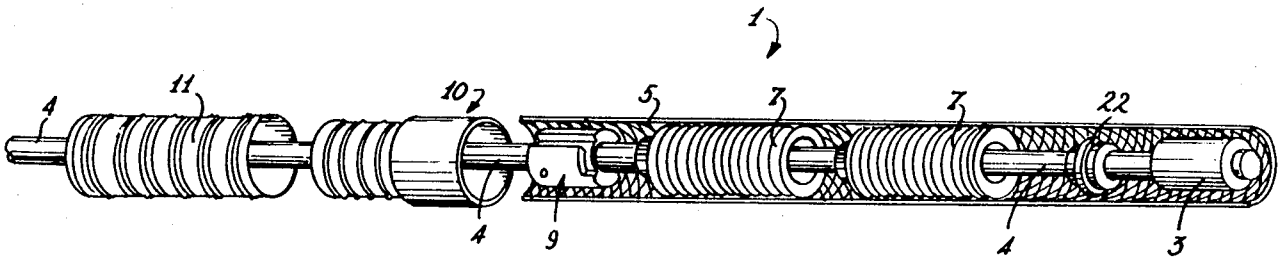
FIG. 12 is a view of the head of the anchorage device when the components wound along the cable have been separated.

FIG. 12 is a view of the head of the anchorage device 1 where all the components strung along the cable 4 have been separated.

proceeding towards the end, there are, fitted in succession, the anchorage sleeve 11, the coupling sleeve 10, the protective cap 5, the cable clamp 9, two sealing components 7, the thrust ring 22, finally the end piece comprising here a threaded sleeve 3 which is in one with the cable 4 and transmits the prestress pull to the sealed mass assembly.

Even though it brings a neat technical solution to the anchorage according to the invention, it is obvious that the threaded sleeve 3 may be replaced by any other equivalent technical solution such as bolted sleeves, a crimped part or any still anchorage of dimensions compatible with the drilling diameter.

In the same manner, the sealing may be obtained by using different sealing materials and notably the synthetic mortars, such as the resin-based mortars (for example, with a base of epoxy resins or acrylic resins).

Moreover, other systems of assembly may be used, ensuring the same function, to join the unlockable connecting components 9 and 10 together, such as, for example, a screw thread of suitable form.

What is claimed is:

1. A method for placing stressing anchorages in rocky ground while using an elongated anchorage device comprising, at a front end, a sealing head and, at a rear end, an anchorage head; a traction component fastened to the sealing head, said traction component being able to ensure, after sealing, a stress action between the sealing head and the anchorage head; an anchorage sleeve surrounding said traction component, said method comprising:

(a) drilling a bore-hole into said ground, said bore-hole extending from a mouth to an end;

(b) locking the traction component and the anchorage sleeve relative to each other by engaging parts fixed on said traction component and on said anchorage sleeve;

(c) forming a cartridge with a charge of sealing material enclosed in an easily destructible casing;

(d) fitting said cartridge at the front of the sealing head;

(e) covering this cartridge with a perforated protective cap resting on the anchorage sleeve;

(f) introducing the anchorage device, bearing said cartridge, into the bore-hole, with the sealing head pointing to the end of the hole;

(g) checking the correct position of said device;

(h) disengaging the traction component with respect to the anchorage sleeve by imparting a twist to the rear end side of said traction component;

(i) crushing said cartridge of said sealing material, by applying a thrust to the rear end side of the traction component;

(j) allowing the sealing material to set;

(k) tensioning the traction element by exerting a pull on its rear end; and (l) fastening the stressed traction component to the anchorage head of the device.

2. The method of claim 1, which further comprises coating, prior to assembly, said traction component with a substance suitable to prevent its adherence to mortar; and injecting, after having placed said traction component under tension, a liquid filling of mortar in the anchorage sleeve, so that said liquid filling fills up said anchorage sleeve and rises between said anchorage sleeve and the borehole.

3. An anchorage device for anchorage under stress in rocky ground, said anchorage device designed to be placed in position in a bore-hole, said bore-hole extending from a mouth to an end, said device having a front end to be placed towards the end of the bore-hole, and a rear end which projects from the mouth of the bore-hole, said anchorage device comprising:

(a) a sealing head suitable to be sealed in rock, towards the end of the bore-hole;

(b) an anchorage head suitable to rest around the mouth of the bore-hole;

(c) a traction component fastened to the sealing head, said traction component being suitable to ensure a stress traction between the sealing head and the anchorage head;

(d) an anchorage sleeve suitable to be cemented in place, said anchorage sleeve surrounding said traction component and extending from the anchorage head to the sealing head;

(e) a cartridge comprised of a charge of sealing material enclosed in an easily destructible casing, said cartridge being fitted at the front of the sealing head prior to use;

(f) a perforated protective cap fixed to the front of the anchorage sleeve and surrounding said cartridge of sealing material; and (g) unlockable connecting components which lock together the sealing head and the anchorage sleeve, said components being suitable to be disengaged from each other by exerting a twist to the rear end of the traction component.

4. The anchorage device of claim 2, wherein the casing enclosing the sealing material is a thin sheet of polymer material.

5. The anchorage device of claim 3, wherein the anchorage sleeve is closed at its rear end side by an end piece fitted on the anchorage head, said anchorage head being crossed by two openings connecting outer atmosphere, respectively, with the inner volume of the sleeve and with the volume of the bore-hole outside the sleeve, said two volumes being placed in communication, towards the front of the anchorage device, through the perforated protective cap.

6. The anchorage device of claim 5 wherein the traction component is provided with a coating suitable to prevent its adherence to cement.

7. The anchorage device of claim 6 wherein the traction component is a single strand sleeved greased cable, coated with a grease surrounded by a sleeving.

8. The anchorage device of claim 7 wherein the single strand sleeved greased cable is bared along part of its length of its sleeving and the grease with which it is covered.

9. The anchorage device of claim 3 wherein the sealing head comprises a plurality of modular sealing components having a profile suitable to assist the transmission of their anchorage force to the rock, via the sealing material strung along on the traction component.

10. The anchorage device of claim 3, wherein the connecting component between the sealing head and the anchorage sleeve is a bayonet fitting.

11. The anchorage device of claim 3 wherein the protective cap of the sealing cartridge is a perforated liner.

12. The anchorage device of claim 3, wherein the end of the traction component is fitted with a threaded sleeve.

13. An anchorage device for anchorage under stress in rocky ground designed to be placed in position in a bore-hole, said bore-hole extending from a mouth to an end, said device having a front end to be placed towards the end of the bore-hole, said anchorage device comprising:

(a) a sealing head suitable to be sealed in the rock towards the end of the bore-hole;

(b) an anchorage head suitable to rest around the mouth of the bore-hole;

(c) a traction component, the front end of which is fastened to the sealing head, said traction component being suitable to ensure a stress traction between the sealing head and the anchorage head;

(d) an anchorage sleeve suitable to be cemented in place surrounding said traction component, said anchorage sleeve extending from the anchoring head to the sealing head;

(e) a cartridge comprised of a charge of sealing material enclosed in an easily destructible casing, said cartridge being fitted at the front of the sealing head prior to use;

(f) a perforated protective cap fixed to the anchorage sleeve and surrounding said cartridge of sealing material; and (g) unlockable connecting components locking together the sealing head and the anchorage sleeve, said components being constituted by a bayonet fitting, said connecting components being suitable to be disengaged from each other by exerting a twist to the rear end of the traction component;

the anchorage sleeve being closed at its rear end side by an end piece fitted on the anchorage head, said anchorage head being crossed by two openings connecting outer atmosphere, respectively, with the inner volume of the sleeve and with the volume of the bore-hole outside the sleeve, said two volumes being placed in communication, towards the front of the anchorage device, by the perforated protective cap;

the sealing head comprising several modular sealing components having profile suitable to assist the transmission of their anchorage force to the rock, via the sealing material, said components being strung along on the traction component;

the traction component being a single strand sleeved greased cable with a sleeving and is provided with a coating suitable to prevent its adherence to the cement; and the end of said traction component being fitted with a threaded sleeve.

14. The anchorage device of claim 13. wherein the traction component is deprived, along a part of its length, of its sleeving and the coating with which it is covered.

15. The anchorage device of claim 13, wherein the protective cap of the cartridge of sealing material is a perforated liner.

16. The anchorage device of claim 13, wherein the casing enclosing the sealing material is a thin sheet of polymer material.

17. The anchorage device of claim 3, wherein the traction component is a flexible cable.

* * * * *

UNITED STATES PATENT AND TRADEMARK OFFICE

CERTIFICATE OF CORRECTION

PATENT NO. : 4,832,534

DATED : May 23, 1989

INVENTOR(S) : Jean-Claude Duvieusart

It is certified that error appears in the above-identified patent and that said Letters Patent is hereby corrected as shown below:

Claim 4, line 1, change "claim 2" to --Claim 3--.

Claim 13, line 5, after "bore hole" insert --and a rear end which projects from the mouth of the bore --.

Signed and Sealed this

Twelfth Day of June, 1990

*Attest:*

HARRY F. MANBECK, JR.

*Attesting Officer*

*Commissioner of Patents and Trademarks*